US005860479A

United States Patent [19]

LaFollette

[11] Patent Number: 5,860,479

[45] Date of Patent: Jan. 19, 1999

[54] REMOTE FIREFIGHTING APPARATUS

[76] Inventor: David A. LaFollette, 1700 Linda Vista Dr., Ukiah, Calif. 95482

[21] Appl. No.: 823,174

[22] Filed: Mar. 25, 1997

Related U.S. Application Data

[60] Provisional application No. 60/021,270 Jul. 12, 1996.

[51] Int. Cl.[6] ..... A62C 27/00

[52] U.S. Cl. ..... 169/24; 169/52

[58] Field of Search ..... 169/24, 52

[56] References Cited

U.S. PATENT DOCUMENTS

| | | | |
|---|---|---|---|
| 3,155,319 | 11/1964 | Hammelmann | 169/24 |
| 3,724,554 | 4/1973 | Rupert et al. | 169/24 |
| 3,762,478 | 10/1973 | Cummins | 169/24 |
| 5,301,756 | 4/1994 | Relyea et al. | 169/24 |

FOREIGN PATENT DOCUMENTS

| | | | |
|---|---|---|---|
| 1191449 | 5/1970 | United Kingdom | 169/24 |
| 93023116 A1 | 11/1993 | WIPO | 169/52 |

*Primary Examiner*—Gary C. Hoge
*Attorney, Agent, or Firm*—Larry D. Johnson

[57] ABSTRACT

A firefighting vehicle can be transported to a fire, connected to a water supply hose, and maneuvered by remote or self-contained control to dispense water from the supply hose through a nozzle and onto the fire. The apparatus may be driven by a pair of independent, continuous tracks, and may include a video monitor to transmit real-time images to the operator to view the fire and control the apparatus. The nozzle and monitor may be mounted in a vertically rotatable turret portion, enabling water discharge from ground level to past vertical.

1 Claim, 4 Drawing Sheets

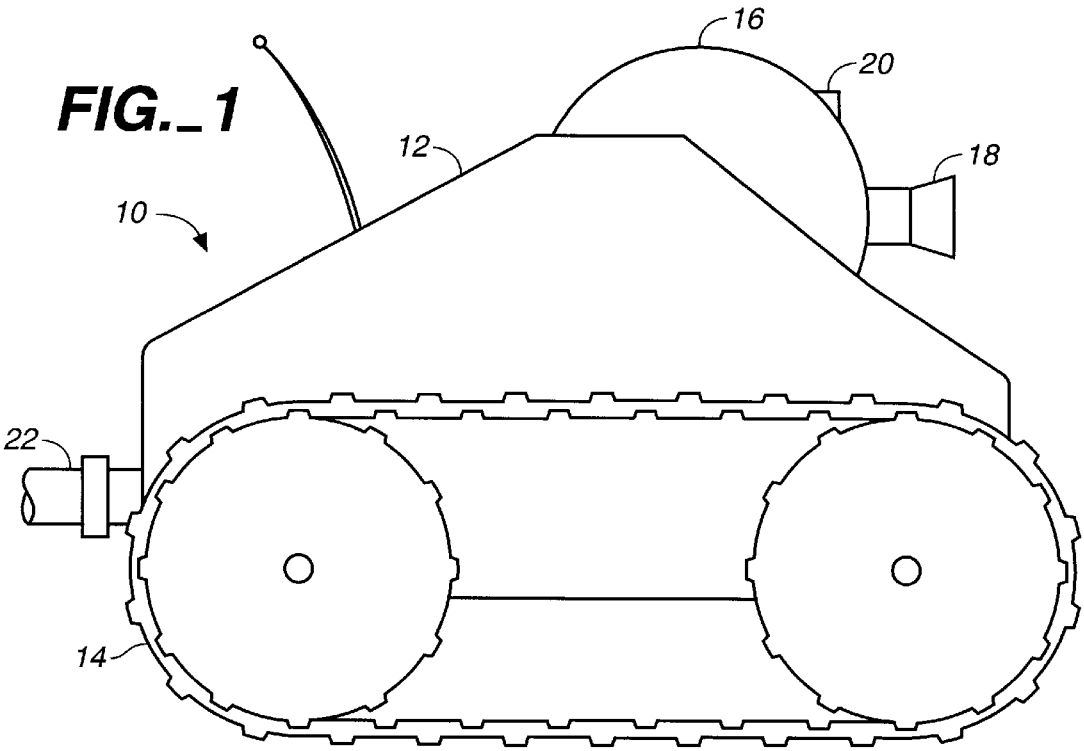
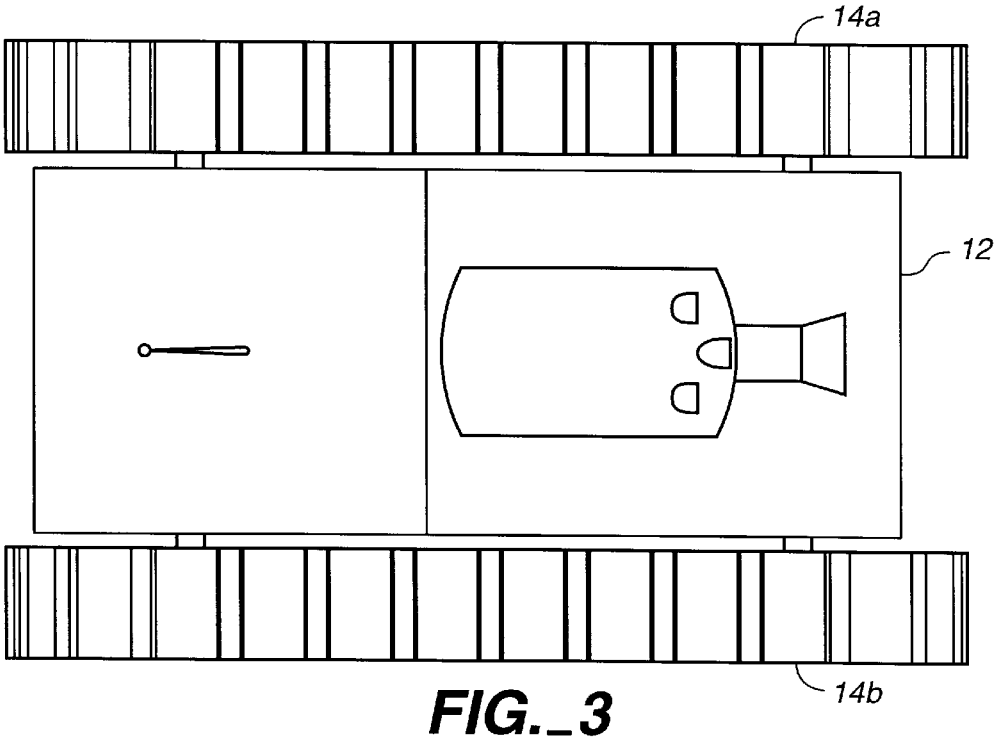
FIG._3

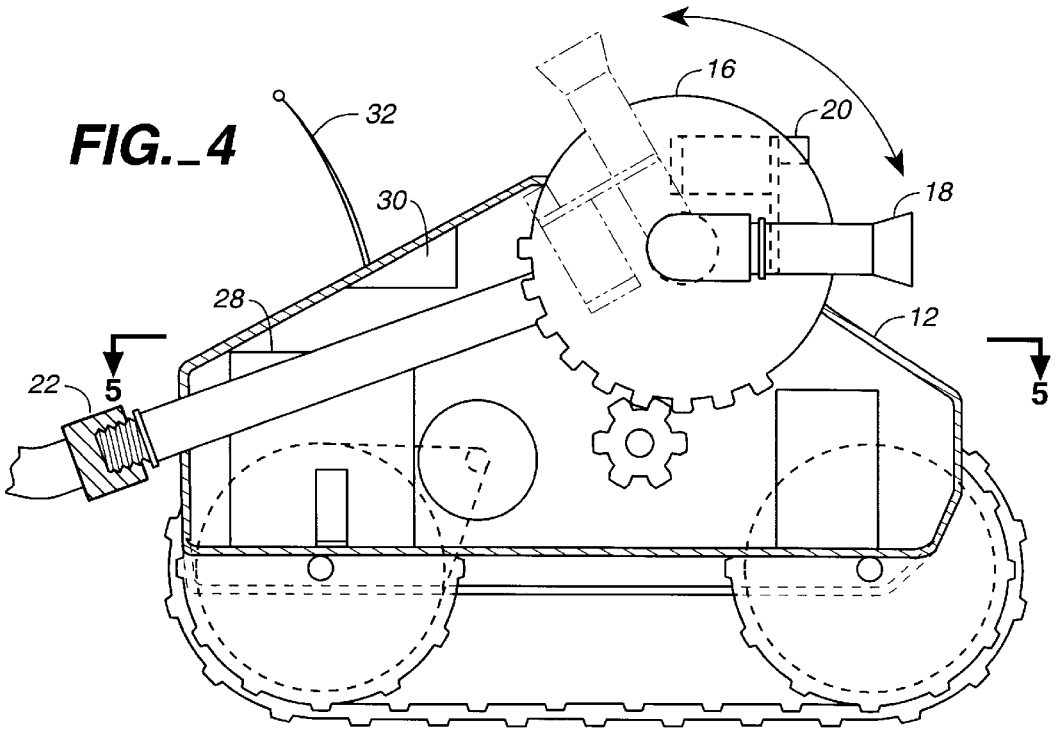
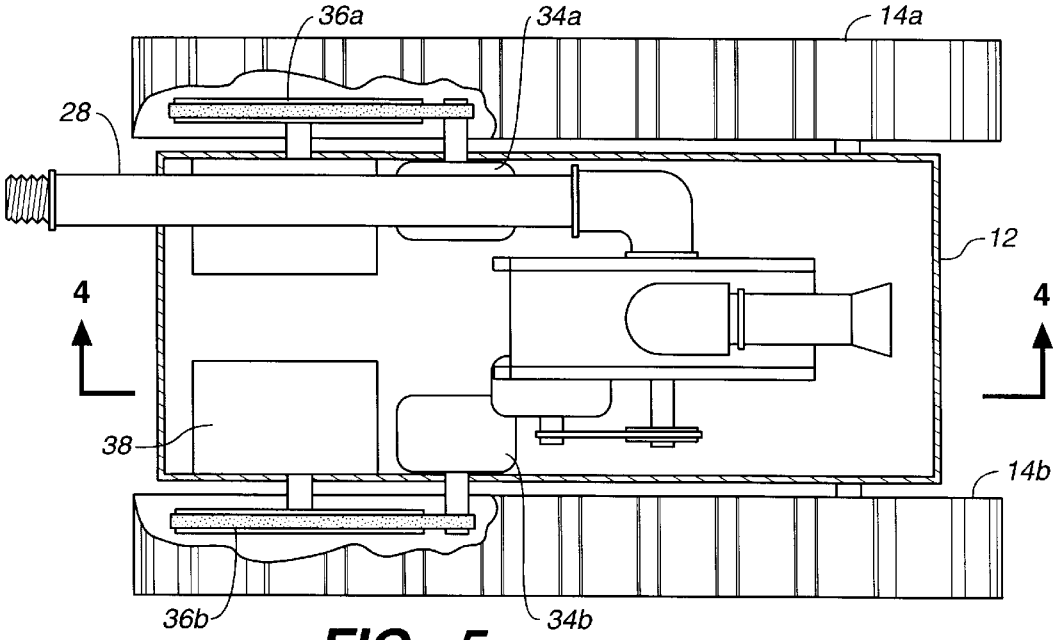
FIG._5

REMOTE FIREFIGHTING APPARATUS

BACKGROUND OF THE INVENTION

1. Field of the Invention

This invention relates generally to fire protection equipment and associated hardware, and more specifically to an improved remote firefighting apparatus for use on wildland, structure or industrial fires.

2. Description of the Prior Art

Fire protection and firefighting equipment are of course well known and in widespread use. Some mechanical or robotic firefighting devices have been developed in an effort to limit or even eliminate the exposure of firefighting personnel to the hazards of a fire, as well as to permit firefighting in remote areas or areas inaccessible to humans. However, known robotic firefighting devices have many shortcomings, including limited firefighting capacity, poor traction and climbing ability, and restricted application to certain types of fires (e.g., structure fires only).

SUMMARY OF THE INVENTION

The remote firefighting apparatus of this invention provides a firefighting vehicle which can be transported to the general location of a fire, connected to a water supply hose, and maneuvered by remote or self-contained control to the actual fire, and there to dispense water from the supply hose through a nozzle and onto the fire. The apparatus is preferably driven by a pair of independent, continuous tracks, thereby enabling superior turning and climbing ability. The apparatus may include a video monitor to transmit real-time images to the operator (who is preferably situated a safe distance from the fire), who may thus view the fire and control the apparatus. The nozzle and monitor are preferably mounted in a vertically rotatable turret portion on top of the vehicle, enabling water discharge (and video monitoring thereof) from 0° (ground level) to approximately 120° (past vertical) or more, including a 90° (vertical) "self-protection" position which saturates the apparatus itself with water.

The remote firefighting apparatus of this invention thus provides a unique assembly of parts designed to deliver up to 500 gpm water or more to a fire without exposing firefighting personnel to the danger and hazards of the fire. Features of the inventive apparatus include, but are not limited to, the following:

- radio or other remote control, or self (automatic) control;
- transmitting video camera, in normal, infrared, or other wavelengths, with the viewing monitor placed in a remote pickup truck or other location, to allow the operator to view the fire and control the apparatus in relative safety;
- the apparatus pulls the supply hose from fire engine pump to the fire, thereby eliminating the need for large (self-contained) storage capacity on the vehicle;
- continuous track design, with each track independently controlled, so that the apparatus can climb stairs or over obstacles, reverse, and turn in a tight radius;
- constructed in a housing of thermoplastic or similar fire resistant, very strong material, which is easy to construct and mass produce;
- may include an optional tool mounting platform the front topside of the apparatus.

The apparatus may of course be made in any appropriate size, including:

a. wildland version: approximately 30 inches wide, with a low center of gravity, with a 200 gallons per minute (gpm) nozzle, and which pulls a 1 ½ inch hose;

b. structure version: approximately 22 inches wide (to navigate narrow corridors and doorways within a building), with a 3 inch supply hose and a 270 gpm nozzle;

c. industrial version: approximately 30 inches wide, with 3 inch plumbing and a 500 gpm nozzle.

The inventive apparatus is thus designed for various firefighting applications, and to go into hazardous areas by pulling a water supply hose behind it. It can go up steep hills or into narrow doorways, giving the incident commander a new firefighting tool, labor free. It is small enough to fit into a pickup truck, which may be equipped with a TV monitor and remote control.

The apparatus may include a parking brake which can be applied when the monitor is flowing water, especially when higher gallons per minute are flowing. Another variation may provide a portable control head, suitable for operations in highrise buildings and metal buildings.

BRIEF DESCRIPTION OF THE DRAWINGS

FIG. 1 is a side elevation view of a remote firefighting apparatus of this invention;

FIG. 3 is a top plan view thereof;

FIG. 4 is a side elevation cross-sectional view thereof, illustrating one possible arrangement for the water supply to the nozzle, and one possible arrangement for turret mobility, this view being taken along line 4—4 of FIG. 5;

FIG. 5 is a top plan cross-sectional view thereof, illustrating one arrangement of driving the independent, continuous tracks, this view being taken along line 5—5 of FIG. 4;

DETAILED DESCRIPTION OF A PREFERRED EMBODIMENT

Figure 2:
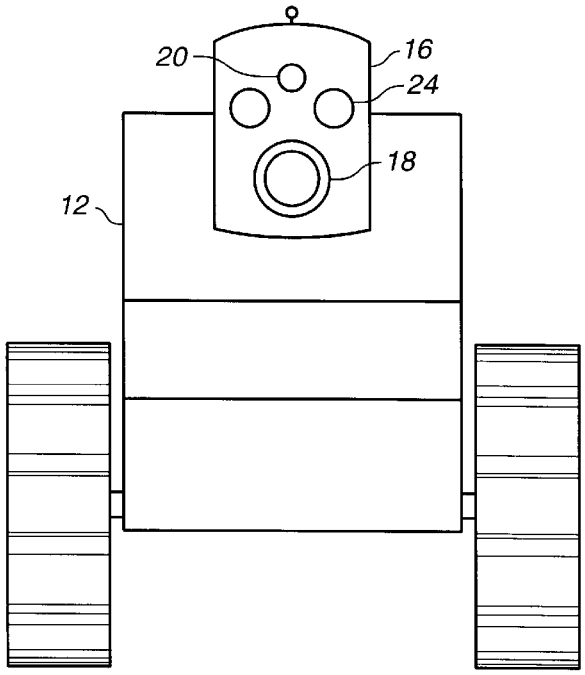
FIG. 2 is a front elevation thereof.

FIG. 1 is a side elevation view of a remote firefighting apparatus 10 of this invention. Apparatus 10 may consist of a firefighting vehicle 12 driven by tracks 14 in a manner well known in the art. The vehicle 12 may include a rotatable turret 16 bearing an adjustable nozzle 18 and video camera 20. Water is delivered to the nozzle 18 through supply hose 22 connected to a truck or hydrant. The vehicle 12 itself may be approximately four feet long and three feet high, i.e., small enough to maneuver and navigate through most building corridors, hallways and doors. This size is also small enough so that the vehicle can be transported to and from a fire in the bed of a typical pickup truck.

FIG. 2 is a front elevation view of the vehicle 12, again illustrating the adjustable nozzle 18, video camera 20, and also illustrating lights 24, which may be appropriate or necessary for adequate viewing by the video camera, especially in the dark and smoky environments that are often encountered near a fire.

FIG. 3 is a top plan view of the vehicle 12 better illustrating the independent continuous tracks 14*a*, 14*b* used to drive and turn the vehicle. This track technology is well known in the art, and is easily adapted to this application. This view also suggests the relatively narrow width of the vehicle, which may be in the range of twenty-two to thirty inches, or more or less.

FIG. 4 is a side elevation cross-sectional view of the vehicle 12, this view illustrating one possible arrangement for connection of the water supply to the nozzle 18. This arrangement delivers the water from supply hose 22 through connector 28 and to the nozzle 18. This view also illustrates the rotational range of the turret 16, such that the nozzle 18 and camera 20 rotate together through a range of approximately 120°. This view also schematically illustrates a transmitter/receiver portion 30 with antennae 32 that can be used for communication with and control of the vehicle by the operator.

FIG. 5 is a top plan cross-sectional view of the vehicle 12, illustrating a possible arrangement for driving the independent continuous tracks 14*a*, 14*b*. Drive motors 34*a*, 34*b* could be used to drive the tracks via belt arrangements 36*a*, 36*b*, pulleys, gears or other well known mechanical connections. Batteries 38 may be used to power the drive motors, transmitter/receiver, camera, lights and other mechanical and electrical components contained on the vehicle.

Figure 6:
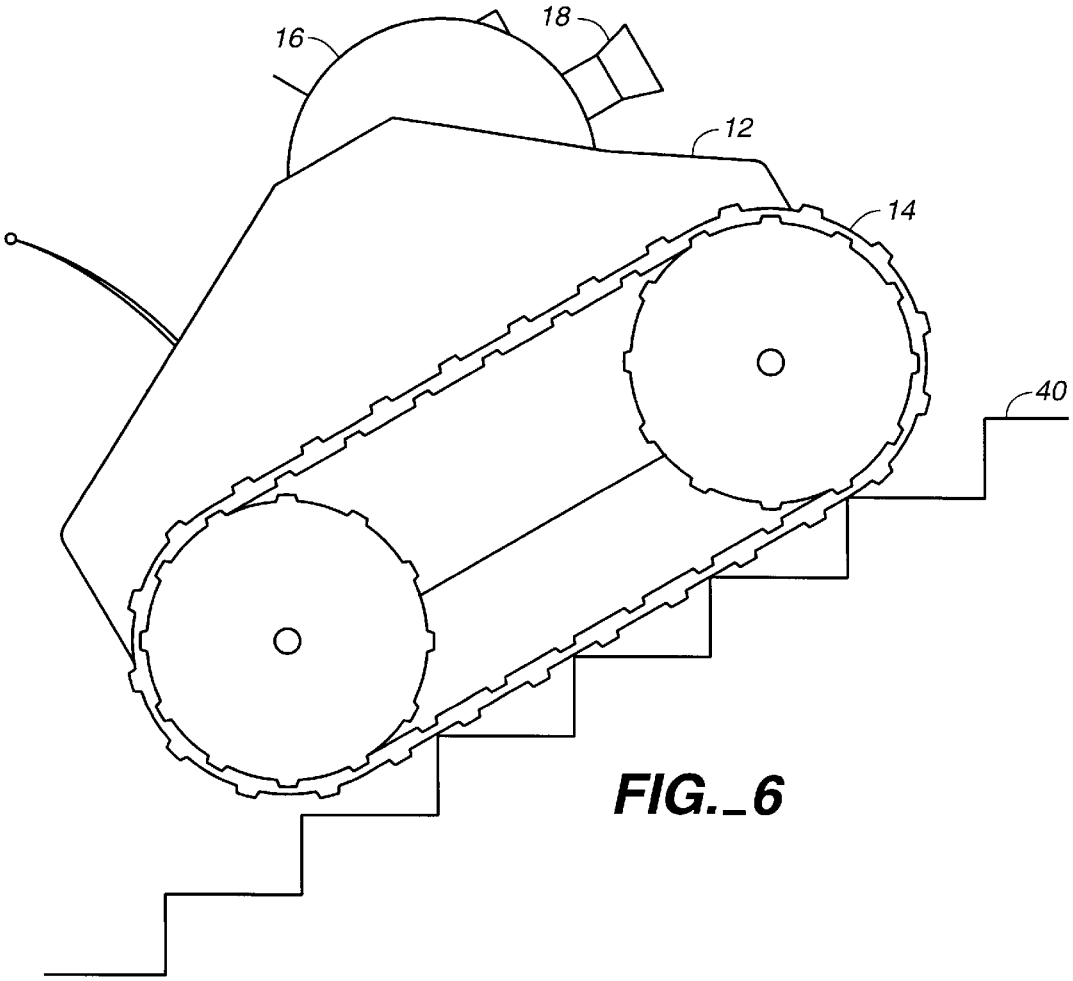
FIG. 6 is a side elevation view of a remote firefighting apparatus of this invention shown climbing inclined steps or stairs.

FIG. 6 is a side elevation view of the vehicle 12 shown climbing a series of inclined steps or stairs 40. Use of track technology enables such climbing, as well as the ability to reverse, or turn within confined spaces.

Figure 7:
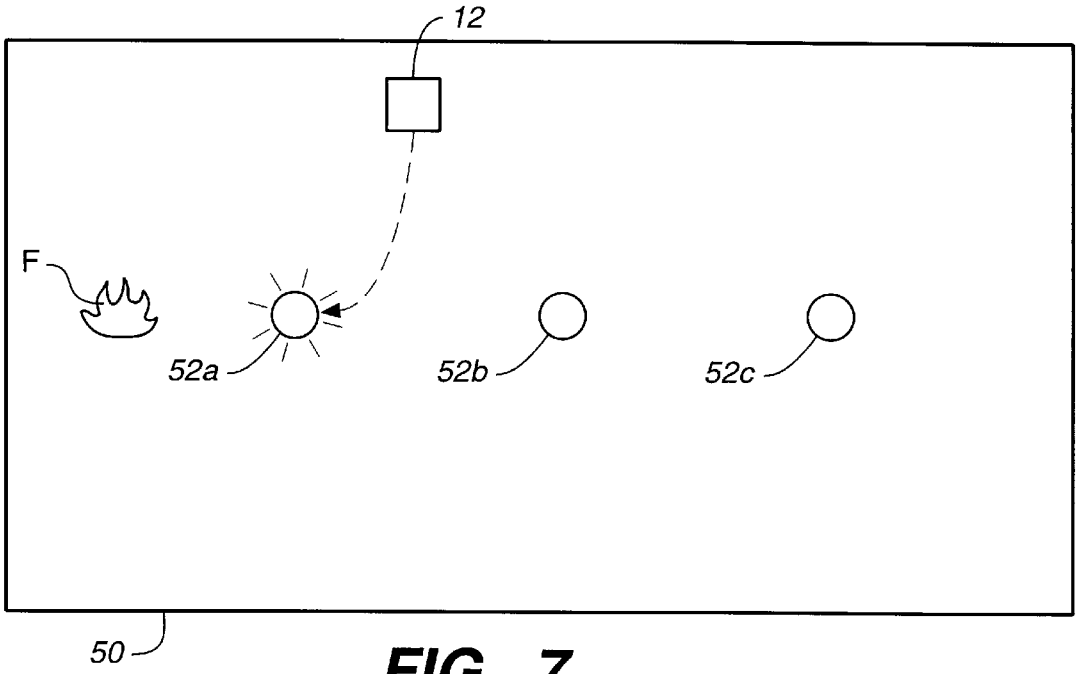
FIG. 7 is a schematic view of a building structure with an isolated fire therein, equipped with spaced smoke alarm devices with differentiated emitters, and a remote firefighting apparatus of this invention equipped with an integral sensor enabling automatic tracking of and maneuvering to the activated smoke alarm.

FIG. 7 is a schematic view of a building structure 50 with an isolated fire F therein. The building may be equipped with a plurality of spaced smoke alarm devices 52*a*, 52*b*, 52*c*, each bearing a differentiated emitter such as an audible alarm in different tones (i.e., a different tone for each prescribed location). The remote firefighting apparatus 12 can be equipped with an integral sensor enabling automatic tracking of these emitted tones, and by incorporation of appropriate circuitry, the sensor could control and maneuver the vehicle to the activated smoke alarm. This arrangement could thus be used as a "self-controlled" or automatic system, requiring minimal or no human operator input.

Figure 8:
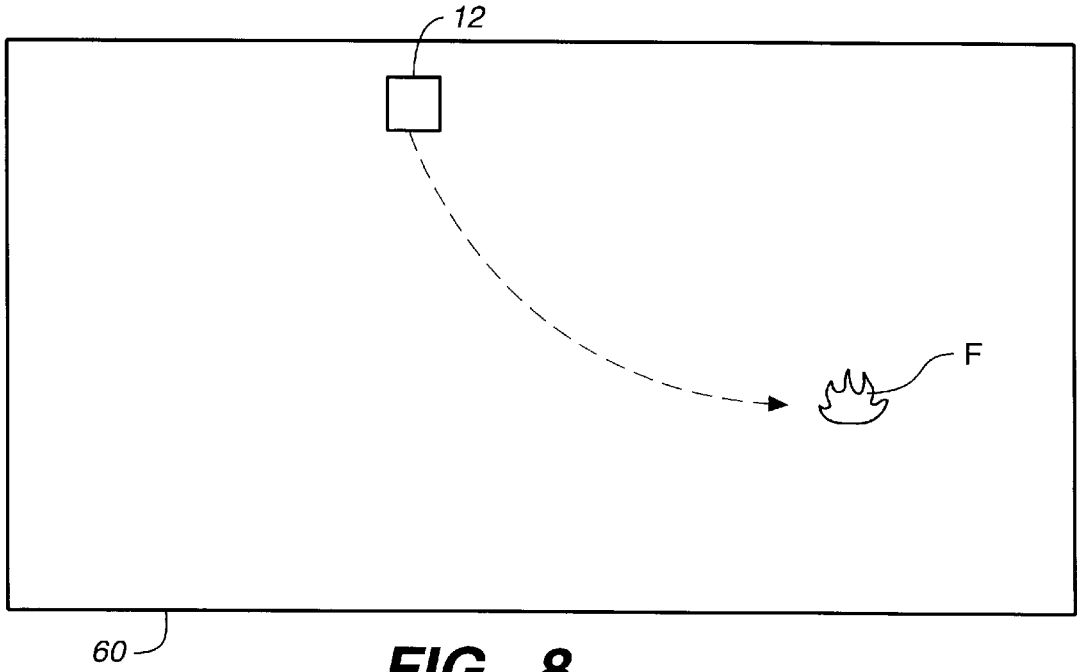
FIG. 8 is a schematic view of a typical building with an isolated fire therein, and a remote firefighting apparatus of this invention equipped with an integral infrared or thermal sensor for sensing of and maneuvering to the fire.

FIG. 8 is a schematic view of a typical building structure 60 with an isolated fire F therein, with the remote firefighting apparatus 12 now equipped with an integral infrared or thermal sensor for the sensing of the fire F. Again, through incorporation of available circuitry and technology, the thermal sensor could be used to operate and maneuver the vehicle 12 to the location of the fire, automatically extinguishing the fire with water.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A remote firefighting apparatus for fighting fires in a building containing at least one smoke alarm bearing an emitter, said firefighting apparatus comprising:

a firefighting vehicle driven by continuous tracks, a rotatable turret connected to said vehicle, said turret including a nozzle;

a water supply hose connected to said nozzle; and integral sensor means for tracking of the smoke alarm emitter and maneuvering to a fire.

* * * * *